United States Patent [19]

Hinze

[11] 4,103,892

[45] Aug. 1, 1978

[54] LIGHT ACTUATED TARGET CONTROL FOR AN AMUSEMENT DEVICE

[75] Inventor: George B. Hinze, Westminster, Calif.

[73] Assignee: Walt Disney Productions, Burbank, Calif.

[21] Appl. No.: 798,606

[22] Filed: May 19, 1977

[51] Int. Cl.[2] ..... F41J 5/02; F41J 9/00

[52] U.S. Cl. ..... 273/101.1; 273/102.2 R

[58] Field of Search ..... 35/25; 273/101.1, 101.2, 273/102.2 R, 102.2 B, 102.1 R, 102.1 E, 105.2, 105.6, 108, 127 R, 181 H

[56] References Cited

U.S. PATENT DOCUMENTS

| | | | |
|---|---|---|---|
| 2,188,292 | 1/1940 | Hall et al. | 273/101.1 X |
| 2,269,258 | 1/1942 | Falkenberg | 273/101.1 |
| 2,275,150 | 3/1942 | Kenney et al. | 273/101.1 X |
| 2,287,429 | 6/1942 | Hooker et al. | 273/101.1 |
| 2,308,814 | 1/1943 | Kenney et al. | 273/101.1 |
| 2,309,614 | 1/1943 | Jensen | 273/101.1 |
| 2,310,084 | 2/1943 | Hooker et al. | 273/101.1 |
| 3,170,689 | 2/1965 | Brown et al. | 273/101.1 X |
| 3,218,461 | 11/1965 | Saunders et al. | 273/105.6 X |
| 3,220,732 | 11/1965 | Pincus | 273/101.1 |
| 3,376,039 | 4/1968 | Fenton | 273/101.1 |
| 3,995,376 | 12/1976 | Kimble et al. | 273/101.1 |
| 4,032,146 | 6/1977 | Kim | 273/105.6 |
| 4,052,066 | 10/1977 | Ohta | 273/101.1 |

*Primary Examiner*—Richard C. Pinkham
*Assistant Examiner*—Vance Y. Hum
*Attorney, Agent, or Firm*—Fulwider, Patton, Rieber, Lee & Utecht

[57] ABSTRACT

A target control is provided for an amusement device to propel a target in translational motion along a predetermined path and to accelerate the movement of the target when it is struck by a beam of radiation. Preferably, in addition to accelerating the target, the target control reverses the direction of target movement. In this way a visible indication is given to a viewer that the target has been hit, yet the target is still available for further beams of radiation to be directed at it.

10 Claims, 6 Drawing Figures

FIG. 1
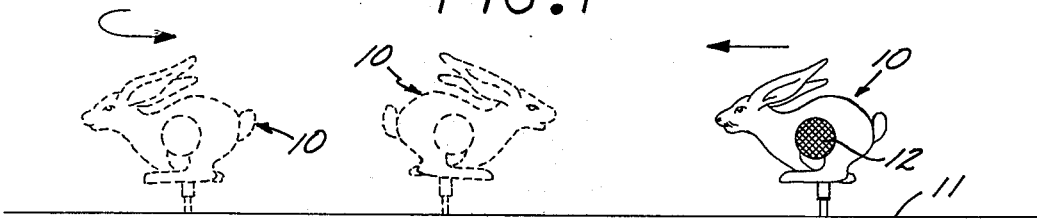
FIG. 2
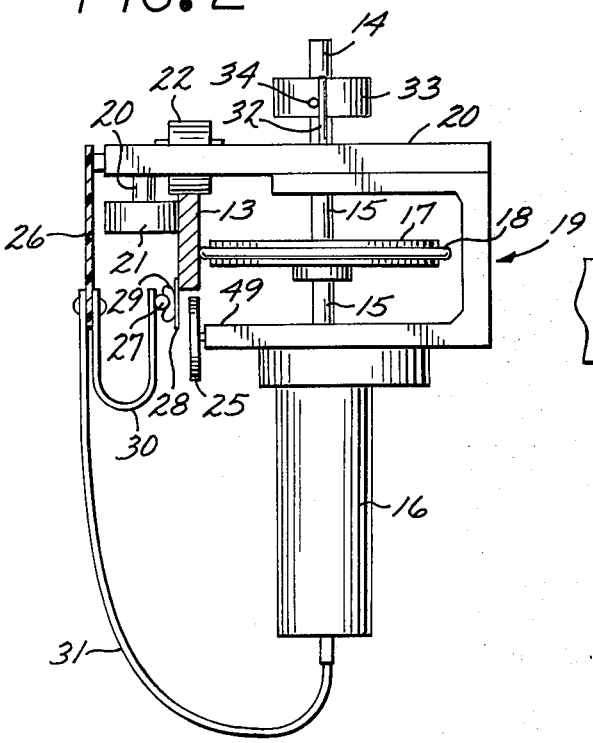
FIG. 3
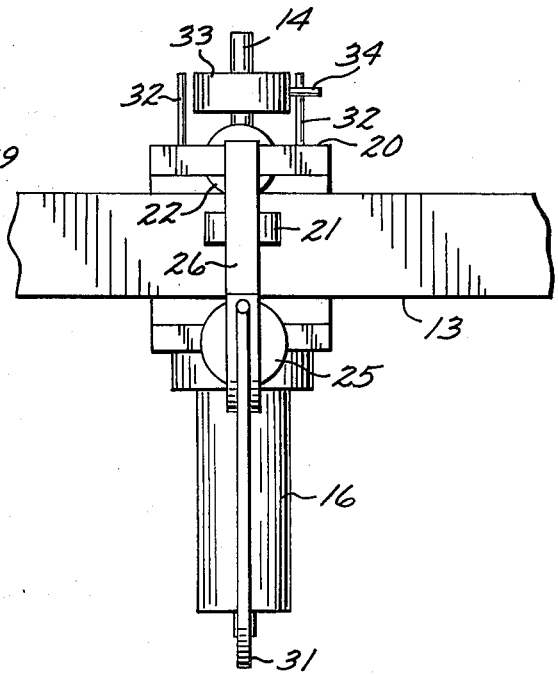
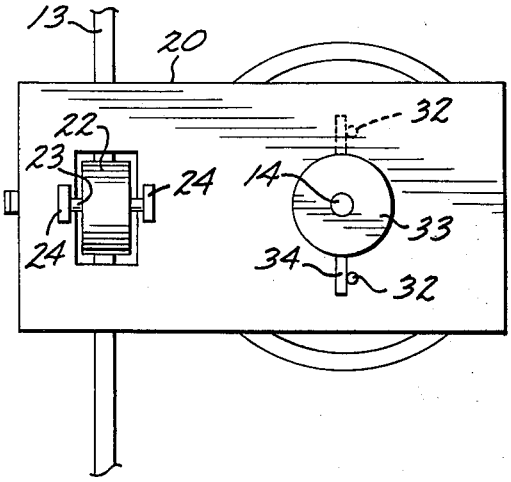
FIG. 4
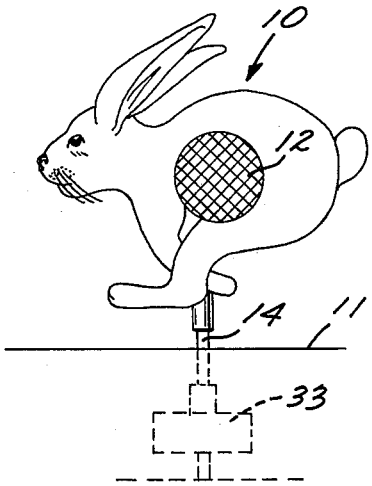
FIG. 5

LIGHT ACTUATED TARGET CONTROL FOR AN AMUSEMENT DEVICE

THE FIELD OF THE INVENTION

The present invention relates to a control for a target in an amusement device in which a replicia of a weapon is aimed at a target moving along a predetermined path.

BACKGROUND OF THE INVENTION

In conventional amusement devices, targets are typically moved along predetermined paths in translational motion at a distance from amusement device patrons who aim weapon simulations at the targets. Typically, the weapons are designed to simulate rifles or pistols, but instead of emitting actual projectiles, emit beams of light energy laser energy or other beams of energy. The amusement device patrons aim the weapons at the targets which move in paths generally perpendicular to the direction in which the beam of radiation travels.

Several devices may be employed to verify to interested persons that a target has been hit. Naturally the person most interested is typically the individual who fired at the target. In conventional systems, the method of informing the patron that he has scored a hit involves a target control device that reacts to an accurately aimed beam of radiation to drop the target, or otherwise remove the target from the view of the patron. Other systems involve various registers, including digital displays of hits scored, lights, bells and buzzers.

The foregoing prior art systems are generally inadequate to effectively communicate the fact of achievement of an accurate hit, however. In amusement devices such as shooting galleries, where patrons seek to test their skill at aiming at targets, there is frequently a great deal of noise and confusion in the immediate area. Furthermore, when a target drops it is sometimes difficult to tell whether or not it was the target at which the patron's aim was directed. Systems of bells, lights, and registers are likewise inadequate to indicate a degree of success of the individual patronizing the amusement shooting gallery because it is typically quite difficult to correlate changes in the display with the efforts of a particular patron. One can not immediately determine which shot or which person aiming and firing at a target was responsible for a hit as indicated in the display. This is due in part to the difficulty in associating particular registers or lights, buzzers or bells with the firing of a particular individual in a crowded shooting gallery. In those systems in which targets are dropped from view upon being hit successfully, it is sometimes difficult to ascertain whether the absence of a target was the direct result of the last shot or whether the patron merely lost track of the target.

SUMMARY OF THE INVENTION

It is an object of the present invention to provide a positive indication to an individual firing a simulated weapon in a shooting gallery or other amusement device to indicate an accurate shot at a particular target. This object is achieved by causing the target to rapidly accelerate in its movement, rather than to fall from view or merely continue along an invariable course. The accelerative movement of the target not only provides an indication of an accurate shot, but increases the action in the device, and hence heightens the interest of the patron. After progressing along its path at accelerated rate for a short distance, a distance adequate to provide a positive indication of a direct hit, the target reduces its velocity to its previous level so that further hits upon it can be detected. The combined motion of direction reversal and increased velocity of movement provides a much more interesting and discernable means for detecting accurate shots then is available in conventional devices.

A further object of the invention is to achieve the altered target movement through a control that is entirely electrical in its operation. This minimizes the mechanical complexity of the device, thus reducing the instances of device malfunction and the necessity for maintenance and repair. Moreover, by using solid state electronics to control target movement, a very durable amusement target control is provided at a remarkably low cost.

DETAILED DESCRIPTION OF THE DRAWINGS

FIG. 1 illustrates the manner of movement of a target according to the invention.

FIG. 2 is an end view of the target track and control mechanism.

FIG. 3 is a front view of the device of FIG. 2

FIG. 4 is a plan view of the device of FIG. 2.

FIG. 5 is an enlarged view of the target of the invention.

DETAILED DESCRIPTION OF THE INVENTION

Figure 6:
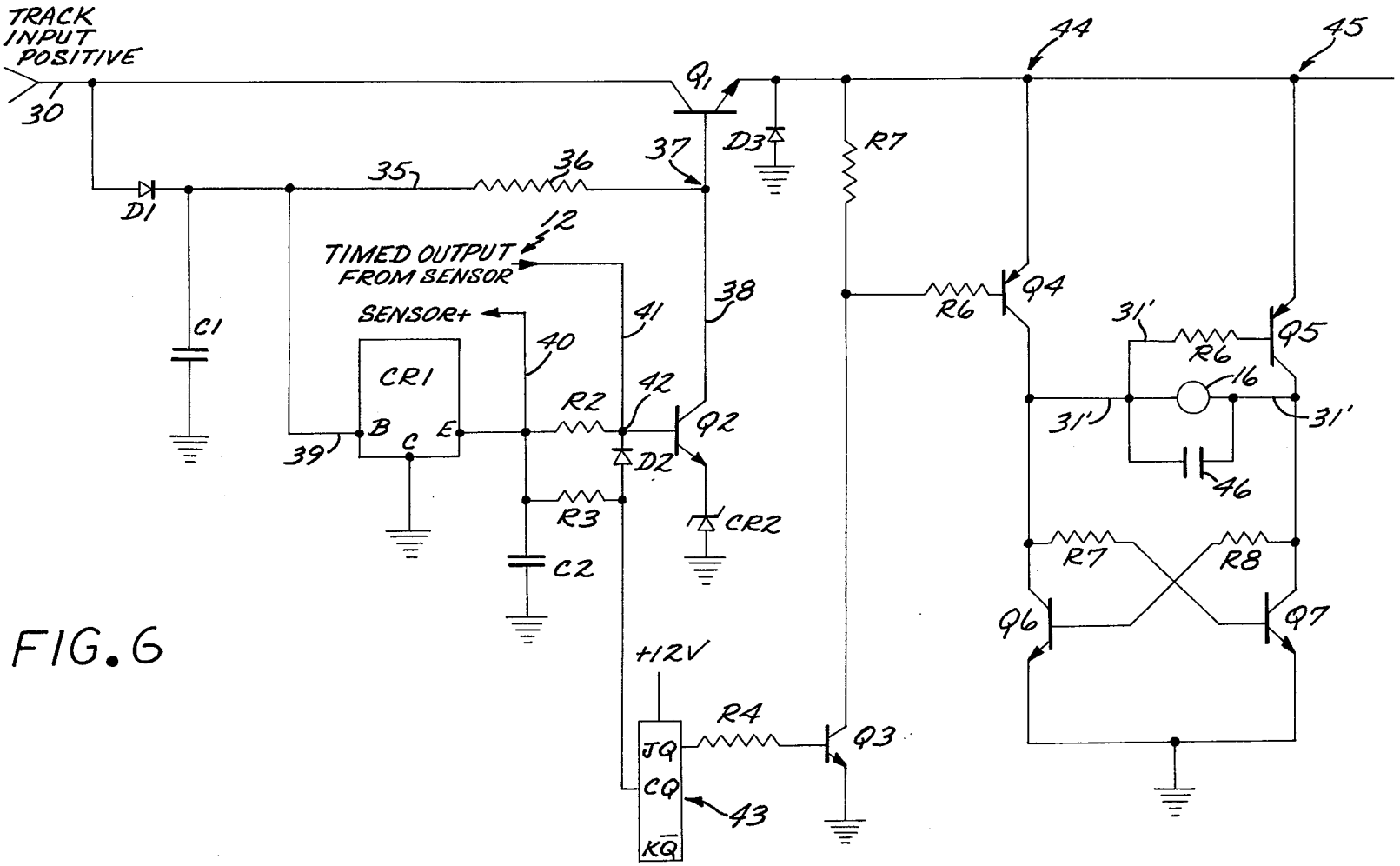
FIG. 6 is a schematic diagram of the electrical target control of the invention.

The device of the invention provides a reaction circuit, such as the circuit of FIG. 6 for an amusement device in which a beam of energy is directed at a target 10, depicted as a hare in FIGS. 1 and 5. The target 10 protrudes above a facade or shield 11 which hides the target track and control system from view. The target 10 is equipped with a photosensitive element 12 which preferably is responsive to laser radiation since a beam of laser radiation can be of such a low intensity as to be harmless and can also be used in either light or dark areas and at a considerable distance from the target. A device simulating a rifle in appearance and suitable for use in directing laser radiation beams at targets is described in U.S. application Ser. No. 575,530 filed May 8, 1975, now abandoned.

The target 10 is constrained to move along a predetermined path defined by the longitudinal alignment of a track 13 which extends the width of a shooting gallery. Each of a number of targets 10 is mounted atop an upright support 14 which is directly or indirectly connected to a shaft 15 of a motor 16. In the device of the invention the motor 16 operates on direct current and through the shaft 15 turns a driving disk 17 horizontally oriented and perpendicular to a longitudinal surface of the track 13. The driving disk 17 has a rubber rim 18 encircling the disk 17 and forming the contact surface with the track 13. The motor 16 is mounted on a frame 19 that is of generally U-shaped configuration having arms that extend toward and bracket the track 13. The upper arm 20 of the frame 19 extends laterally above and beyond the track 13 and has extending downward therefrom an axle 48 upon which is mounted a roller 21 which is horizontally aligned and parallel with the disk 17 and located on the opposite side of track 13 therefrom. Thus, the roller 21 provides a countervailing force to aid in holding the driving disk 17 in contact with the track 13. Similarly, within an aperture in the upper arm 20 of the frame 19 there is mounted another roller 22 supported on an axle 23 mounted between brackets 24 on the upper arm 20. The roller 22 thereby rides along the upper edges of the track 13 to form yet another contact support for the target assembly.

A rotatable idler wheel 25 is mounted on the lower arm 49 of the bracket 19 to provide a surface of contact with the lower edge of the track 13 in the event that the upper roller 22 loses contact with the upper edge of the track 13.

Fastened to the frame 19 is a printed circuit board 26 that includes the electronic target transporter controls depicted in FIG. 6. Electrical power is supplied to the printed circuit board 26 by an electrically conductive bus rod 27 that extends the length of the track 13 and is attached thereto by a mounting strip 28 and an insulating bed or trough 29. An electrically conductive spring metal strap 30 of U-shaped configuration is connected to the printed circuit board 26 and is biased into contact with the electrically conductive bus rod 27 to draw electrical power from that bus and to serve as an electrical voltage supply and power source. An electrical cable 31 transmits power from the printed circuit board 26 to the direct current motor 16.

Extending upward from the upper lateral surface of the upper arm 20 of frame 19 are two parallel upright limit pins 32 arranged 180° opposite each other and lying in the plane passing through the target support 14 and parallel to the track 13. Whenever the motor 16 reverses its direction of rotation, it reverses the direction of rotation of shaft 15. This causes the disk 17 to reverse its direction of rotation which in turn causes the entire structure attached to the bracket 19 to reverse direction of movement along track 13. The reverse in direction of rotation also causes the disk 17 to act through a clutch 33 to rotate the target support 14. However, the target support 14 is attached rigidly to the housing of the clutch 33 from which a longitudinally oriented pin 34 extends. Once the target support 14 has rotated 180° following reversal of the directon of rotation of the motor 16, the pin 34 strikes one of the pins 32 as indicated in FIG. 3. The upright retaining pin 32 prevents further rotation of the support 14 so that the pin 34 thereafter remains extending in the direction away from the direction of travel of the target 10. The clutch 33 thereby causes the target support 14 to become disengaged from the shaft 15 so that the support 14 no longer rotates. The support 14 and the pin 34 will thereby remain in a static orientation moving in translation only in a direction parallel to the track 13 until the next reversal of the motor 16.

The reaction circuit of FIG. 6 drives the direct current electrical motor 16 through leads within the cable 31 indicated in FIG. 6 at 31'. During operation, the motor 16 drives the target 10 in a first direction along the track 13 as determined by the direction of current flow through the leads 31'. The electrical power supply provided by the spring metal pickup 30 provides power for the motor 16 through a driving transistor Q1. The current flowing from the pickup 30 through the transistor Q1 is below the current saturation limit of that transistor.

A transistor bias connection on circuit 35 is connected to the voltage supply 30 and includes a diode D1 and a resistor 36 and is connected to the base of transistor Q1 to bias transistor Q1 into a conducting state below saturation. The voltage connection to the base of transistor Q1 is indicated at 37.

Voltage clamping circuitry including the circuit connection 38 joining the biasing connection at 37 includes a normally conducting semi-conductor element, such as the transistor Q2, which serves as a switching circuit and which drains current from the connection at 37 to the extent that the voltage at point 37 exceeds a steady state bias level established by zener diode CR2. The voltage clamping circuitry is connected through zener diode CR2 to ground. The voltage clamping circuitry thereby prevents the bias at the base of the transistor Q1 from rising above a preset limit. This maintains the bias on the transistor Q1 to limit the load current therethrough to less than saturation.

A capacitor C1 is connected from the transistor bias connection line 35 to ground to smooth any voltage spikes that might occur by virtue of irregular contact of the pickup 30 against the bus bar 27.

A shunt circuit including a connection line 39 is also connected to the direct current power supply through the spring pickup 30. The shunt circuit line 39 is connected to a voltage regulator CR1, the output of which has a connecting lead 40 coupled to the radiation sensitive element 12. The lead 40 is connected to the positive power bus of radiation sensitive sensor element 12 while a lead 41 is coupled to the output of the radiation sensitive element 12. A resistor R2 is provided between leads 40 and 41, and connection 42 to provide positive bias voltage to the base of Q2 thereby holding it in a conducting state in the absence of a beam of radiation on photodetector 12. However, when a beam of radiation does strike the photodector 12, its output transistor conducts thus drawing current from the voltage regulator CR1 through R2 and lead 41 to ground, thereby removing the bias to the base of transistor Q2 in the voltage clamping circuit.

A timing circuit in the photosensitive element 12, provides the time constant for recovery of the steady state voltage level at point 42. The shunt circuitry from the connection 39 to the point 42 at the base of transistor Q2 thus provides a bias potential to hold the switching circuit formed by the transistor Q2 in a closed position under steady state conditions so that the transistor Q2 is rendered conductive thereby holding the point 37 at a predetermined voltage level.

When a beam of laser energy strikes the photosensor 12, however, current flows through the circuit 39 through the voltage regulator CR1 and through lead 41 to ground, thereby drastically reducing the voltage level at point 42. With reduced voltage level at 42, the transistor Q2 ceases to conduct so that the current drawn through circuit 35 no longer flows to ground through the zener diode CR2. This causes the voltage level at 37 to rise significantly thereby causing an increase in current flow through the transistor Q1, and thus an increase in the power supplied to the motor 16. The circuitry formed by the lead 41 through the normally nonconducting energy sensitive element 12 in the target 10 thereby drains bias potential from the switching transistor Q2 when the radiant energy sensitive element 12 is rendered conductive by a beam of energy, such as a laser beam.

When the voltage clamping circuitry formed by the transistor Q2 and the zener diode CR2 is disabled, the bias at the base of the transistor Q1, indicated at 37, rises to accelerate the movement of the target 10 along the track 13. The period of time during which the accelerated movement of the target 10 continues is determined by the setting of the timing circuit in the photosensitive element 12. The greater the setting, the more time will be required before the voltage at 42 rises to allow the switching transistor Q2 to once again conduct. Appropriate adjustment of the timing circuit provides a time delay in voltage buildup in the shunt circuit thereby delaying re-enablement of the voltage clamping circuitry including the zener diode CR2, to prolong the duration of increased bias at 37 to the driving transistor Q1.

A further feature of the invention in its preferred embodiment is the provision of a polarity reversing means operatively connected between the driving transistor Q1 and the motor 16 and actuable in response to actuation of the normally nonconductive circuit element 12. This polarity reversing means reverses the polarity of electrical power supplied to the motor 16, thereby reversing the direction of travel of the target 10 along the track 13 each time a beam of laser radiation impinges upon the detector 12. The polarity reversing means includes two pairs of transistors alternatively connectable to operate the motor 16 in opposing directions of polarity. One of the transistor pairs includes the transistor Q4 and Q7 while the other transistor pair includes the transistors Q5 and Q6.

The polarity reversing means also includes a flip flop circuit 43 connected by diode D2 to point 42 in the shunt circuitry. Each time the normally nonconductive circuit element 12 conducts to ground, the 12 volt supply to the flip flop circuit 43 provides a pulse at the C lead of flip flop 43 which conducts through diode D2 to ground. Thus, with each momentary ground of the photosensitive element 12, the flip flop 43 reverses the polarity of its output leads so that the Q output alternates between a high and low state. The state of the Q output of flip flop 43 provides a voltage through resistor R4 to the base of another transistor Q3. The presence of a positive voltage at the base of transistor Q3 causes that transistor to conduct, while the presence of a negative voltage at its base causes the transistor Q3 to be nonconductive.

When the transistor Q3 conducts, a voltage drop through resistor R7 reduces the voltage potential applied at resistor R6 to the base of transistor Q4. Thus transistor Q4 is rendered conductive when transistor Q3 conducts. The grounding of point 42 triggers J-K flip flop 43 to bias the base of the transistor Q3. Transistor Q3 in turn biases the base of transistor Q4 to reverse the direction of current applied to the motor 16. That is, current may be conducted through the point 44 and the motor 16 may operate in one direction by virtue of current through transistors Q4 and Q7. Current in this instance flows through the transistor Q1, through point 44, and transistors Q4 and Q7 and through the motor 16 to ground. On the other hand, when the clock pulse to the flip flop circuit 43 removes the base bias to the transistor Q3, conduction through transistor Q3 ceases and a bias at the base of transistor Q4 develops. Transistor Q4 ceases to conduct current to the motor 16. The succeeding connection from the motor 16 to transistor Q6 and then to ground causes the motor 16 to operate in the opposite direction from which it would otherwise operate under the influence of transistors Q4 and Q7. Thus, in one state of the flip flop 43, current is conducted through the transistor Q1 through point 44, through transistor Q4, through line 31', through motor 16, through a subsequent line 31', through transistor Q7 and then to ground. In an alternative state of the flip flop 43, current is conducted through transistor Q1 to point 45. From point 45 current is conducted through transistor Q5 through the motor 16 by way of the line 31' and then to another line 31'. A transistor Q6 conducts current to ground, receiving a bias from the voltage drop across resistor R8. Similarly, resistor R7 biases transistor Q7 during conduction while resistor R6 biases transistor Q5.

In the operation of the invention, when a simulated rifle is aimed at the target 10 and a laser beam impinges upon the photosensitive element 12, the point 42 is grounded. This grounding pulses the flip flop circuit 43 to reverse conduction through either the circuit point 44 and the transistors Q4 and Q7 or through the circuit point 45 and through the transistors Q5 and Q6. Meanwhile, the grounding of point 42 causes Q2 to cease conduction. The failure of transistor Q2 to conduct in turn increases the base bias to transistor Q1 thereby increasing the current passing through the transistor Q1. As previously explained, the ground through photosensitive element 12 presses the J-K flip flop 43. The combination of reversal of current flow through either the circuit point 44 or the circuit point 45 coupled with the increase in current flow through transistor Q1 causes the target 10 to cease movement as indicated by the arrow in the right hand portion of FIG. 1, to reverse direction as indicated at the left in dotted lines in FIG. 1, and to move at an accelerated rate of speed in the direction indicated by the center figure in dotted lines in FIG. 1.

Voltage smoothing devices including diode D3, backed biased to the emitter of transistor Q1, and capacitor 46 connected across the terminals of the motor 16 smooth voltage fluctuations that occur within the system, and suppress noise and backswing voltage.

From the foregoing detailed description, various modifications and alterations to the system described will become readily apparent to those skilled in the field of target transport mechanism. Accordingly, no unnecessary limitations should be construed from the foregoing detailed description, but rather, the invention is described in the following claims appended hereto.

I claim:

1. A reaction circuit for an amusement device in which means for providing a beam of energy is directed at a target constrained to move along a predetermined path comprising:

(a) a direct current electrical motor driving said target in a first direction along said path;

(b) an electrical power supply connected to said motor for supplying direct electrical current thereto through driving transistor means when said driving transistor means is biased to a conducting state below saturation;

(c) a bias connection from an electrical voltage supply to bias said driving transistor means into a conducting state;

(d) voltage clamping circuitry connected to said bias connection and including a normally conductive semiconductor element through which current is drained when voltage in said bias connection exceeds a preselected steady state bias level to thereby maintain a bias voltage;

(e) a shunt circuit connected to a direct current supply to normally bias said semiconductor element into a conducting state;

(f) a ground connection from said shunt circuit including a normally non-conductive circuit element actuable to a conductive state by a beam of energy directed thereat;

whereby actuation of said normally non-conductive circuit element by a beam of energy completes said ground connection to drop the bias from said semiconductor element in said shunt circuit to temporarily disable said bias voltage and increase the bias on said driving transistor means, thereby increasing power to said motor to accelerate said target along said path.

2. The apparatus of claim 1 further characterized in that said beam of energy means provides a laser beam and said normally non-conductive circuit element is rendered conductive in response to said impinging laser beam.

3. The apparatus of claim 2 further characterized in that said normally non-conductive circuit element includes a timing circuit to provide a time delay in voltage buildup in said shunt circuit, thereby delaying re-enablement of said voltage clamping circuitry to prolong the duration of increased bias to said driving transistor means.

4. The apparatus of claim 2 further comprising polarity reversing means operatively connected between said driving transistor means and said motor and actuable in response to actuation of said normally non-conductive circuit element to reverse the polarity of electrical power supplied to said motor, thereby reversing the direction of travel of said target along said path each time a beam of laser radiation impinges upon said normally non-conductive circuit element.

5. The apparatus of claim 4 further characterized in that said polarity reversing means includes first and second transistor means alternatively connected to operate said motor in opposing directions of polarity, and a bistable flip flop circuit having a triggering input from said ground connection connected to alternatively enable one of said first and second transistor means.

6. In a control circuit for a target constrained to move along a linear path in an amusement device in which means for providing a beam of radiant energy is directed at said target from a remote location, the improvement comprising: a direct current motor driving said target in a direction along said linear path, a direct current power connection for driving said motor through a transistor normally biased to conduction below its upper saturation limit, a biasing connection arranged to bias said transistor to conduction, voltage clamping circuitry coupled through a switching circuit to said biasing connection to prevent the bias of said transistor from rising above a preset limit and to maintain a bias on said transistor to limit current therethrough to less than saturation, shunt circuitry providing a bias potential to hold said switching circuit in a closed position, discharge circuitry coupled through a normally non-conducting radiant energy sensitive element in said target to drain bias potential from said switching circuit when said radiant energy sensitive element is rendered conductive by a beam of radiant energy, whereby said voltage clamping circuit is disabled and the bias to said transistor rises to accelerate movement of said target along said path.

7. The improved control circuit of claim 6 further characterized in that said switching circuit is a second transistor and said voltage clamping circuit is a zener diode.

8. The improved control circuit of claim 6 further characterized in that a timing circuit is coupled to said normally non-conducting radiant energy sensitive element to delay the rise of biasing potential to said switching circuit for a predetermined length of time following momentary disablement of said voltage clamping circuit.

9. The improved control circuit of claim 6 further comprising a polarity reversing device coupled in said direct current power connection and actuated to reverse polarity of electrical current supplied to said direct current motor when actuated by an electrical discharge through said discharge circuitry.

10. The improved control circuit of claim 6 wherein a flip flop is connected to a bi-directional power driving circuit that may be polarized to operate said motor in either direction and wherein a trigger lead is connected from said discharge circuit to said flip flop to change the state of said flip flop wherever a discharge occurs through said radiant energy sensitive element.

* * * * *